US008615958B2

(12) United States Patent
Kilgore et al.

(10) Patent No.: US 8,615,958 B2
(45) Date of Patent: Dec. 31, 2013

(54) STEPPED HIDDEN DECKING SYSTEM WITH FASTENER

(75) Inventors: Dorian Kilgore, Southfield, MI (US); William Teller, Lake Orion, MI (US); Todd Hemingway, Metamora, MI (US)

(73) Assignee: A. Raymond et Cie, Grenoble (FR)

( * ) Notice: Subject to any disclaimer, the term of this patent is extended or adjusted under 35 U.S.C. 154(b) by 0 days.

(21) Appl. No.: 13/548,504

(22) Filed: Jul. 13, 2012

(65) Prior Publication Data

US 2013/0014465 A1 Jan. 17, 2013

Related U.S. Application Data

(60) Provisional application No. 61/507,163, filed on Jul. 13, 2011.

(51) Int. Cl.
*E04H 12/00* (2006.01)

(52) U.S. Cl.
USPC ..... 52/650.3

(58) Field of Classification Search
USPC ..... 52/650.3, 586.1, 489.1, 489.2, 512, 52/584.1
See application file for complete search history.

(56) References Cited

U.S. PATENT DOCUMENTS

| | | | | |
|---|---|---|---|---|
| 4,620,403 | A * | 11/1986 | Field | 52/480 |
| 4,925,141 | A * | 5/1990 | Classen | 248/217.2 |
| 5,027,573 | A * | 7/1991 | Commins et al. | 52/489.2 |
| 5,997,209 | A * | 12/1999 | Sachs | 403/388 |
| 6,416,269 | B1 * | 7/2002 | Martel et al. | 411/461 |
| 6,418,693 | B2 * | 7/2002 | Ballard | 52/589.1 |
| 6,871,467 | B2 * | 3/2005 | Hafner | 52/586.1 |
| 7,251,918 | B2 * | 8/2007 | Reif et al. | 52/714 |
| 8,011,153 | B2 * | 9/2011 | Orchard | 52/489.1 |
| 8,225,571 | B2 * | 7/2012 | Orchard | 52/489.1 |
| 2001/0015042 | A1 * | 8/2001 | Ballard | 52/589.1 |
| 2005/0252154 | A1 * | 11/2005 | Martel et al. | 52/712 |
| 2011/0067335 | A1 * | 3/2011 | Gibson et al. | 52/489.2 |
| 2011/0126486 | A1 * | 6/2011 | Eberle, III | 52/586.1 |
| 2011/0197538 | A1 * | 8/2011 | Martel | 52/650.3 |

* cited by examiner

*Primary Examiner* — Mark Wendell
(74) *Attorney, Agent, or Firm* — McDonald Hopkins LLC

(57) ABSTRACT

A fastener for securing first and second decking boards with a joist is shown and described. The fastener may include a joist connecting member capable of engaging the joist, a board connecting member capable of engaging the first decking board, where the board connecting member is generally perpendicular the joist connecting member. The fastener may also include a retention feature laterally spaced from the board connecting member, where the retention feature is capable of engaging the second decking board.

4 Claims, 3 Drawing Sheets

STEPPED HIDDEN DECKING SYSTEM WITH FASTENER

CROSS-REFERENCE TO RELATED APPLICATION

This application claims the benefit of U.S. Provisional Patent Application No. 61/507,163, entitled "Stepped Hidden Decking System," filed on Jul. 13, 2011, which is hereby incorporated in its entirety by reference.

FIELD OF ART

This invention relates generally to a stepped hidden decking system with fastener, and more particularly with a deck fastener for securing deck boards together and to a supporting member that does not protrude from the deck surface.

BACKGROUND OF THE INVENTION

Decking systems commonly include a series of joists supported by a frame. The joists are aligned parallel to one another. Decking boards are connected to the joists and spaced adjacent to one another. Often, a gap is left between the decking boards to allow space for expansion and contraction of the system, specifically expansion and contraction of the decking boards, without damaging the system.

Decking fasteners are used to connect the decking boards to the joists and to one another. Decking boards are commonly mounted perpendicular to the joists such that each decking board is supported by multiple joists. A decking fastener may connect to both the joist and the decking board to prevent the decking board from moving with respect to the joists. Often, fasteners are mounted at the edge of a decking board and further connect to the adjacent decking board. Thus, a single fastener may fix a decking board to both a joist and an adjacent decking board. These fasteners, however, are often visible from on top of the decking boards. This can lead to less than desirable aesthetical appearance for the deck.

In decking and frame construction, it is often desirable to provide a blind or invisible interconnection between the decking boards and the underlying supporting joists. This desire is accentuated with decking that is exposed to the open environment as the exposed connectors may be susceptible to oxidation, leaching and similar environmental affects. Various connectors and decking designs have been proposed to resolve this issue. Though some designs have successfully decreased the aforementioned problems, issues still remain with hidden fastening of decking.

Many decking designs include a space between the decking boards, which results in hidden fasteners still being visible from above. Likewise, these visible fasteners are still susceptible to environmental elements. Therefore, an improved decking system is needed to cure these and other design defects. Specifically, there is a need for an improved deck fastener that appropriately secures the decking boards with the support joists such that the fasteners are generally hidden from above, hidden from the environment, and provide sufficient holding force for the decking system.

DESCRIPTION OF THE DRAWINGS

The operation of the invention may be better understood by reference to the following detailed description taken in connection with the following illustrations, wherein.

SUMMARY

A fastener for securing first and second decking boards with a joist is shown and described. The fastener may include a joist connecting member capable of engaging the joist, a board connecting member capable of engaging the first decking board, where the board connecting member is generally perpendicular the joist connecting member. The fastener may also include a retention feature laterally spaced from the board connecting member, where the retention feature is capable of engaging the second decking board.

A fastener for securing first and second decking boards with a joist may include a generally planar body capable of being positioned between the first and second decking boards and the joist, and a generally U-shaped joist connector attached to the body, the joist connector capable of engaging a side of the joist. The fastener may also include a board connector attached to the body and positioned generally perpendicular to the joist connector, the board connector capable of engaging at least a portion of the first decking board positioning the first board in a predetermined position relative to the joist, and a retention member attached to the body and laterally spaced from the board connector, where the retention member is capable of engaging the second decking board.

A decking system may include at least first and second decking boards juxtaposed each other, a joist having a side, and a fastener secured with the first and second decking boards and the joist. The fastener may include a joist connector secured to the side of the joist, a board connector secured to the first decking board, where the board connector is generally perpendicular the joist connector and positions the first decking board in an operative position relative the joist, and a barb laterally spaced from the board connector, where the barb engages the second decking board.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

Figure 1:
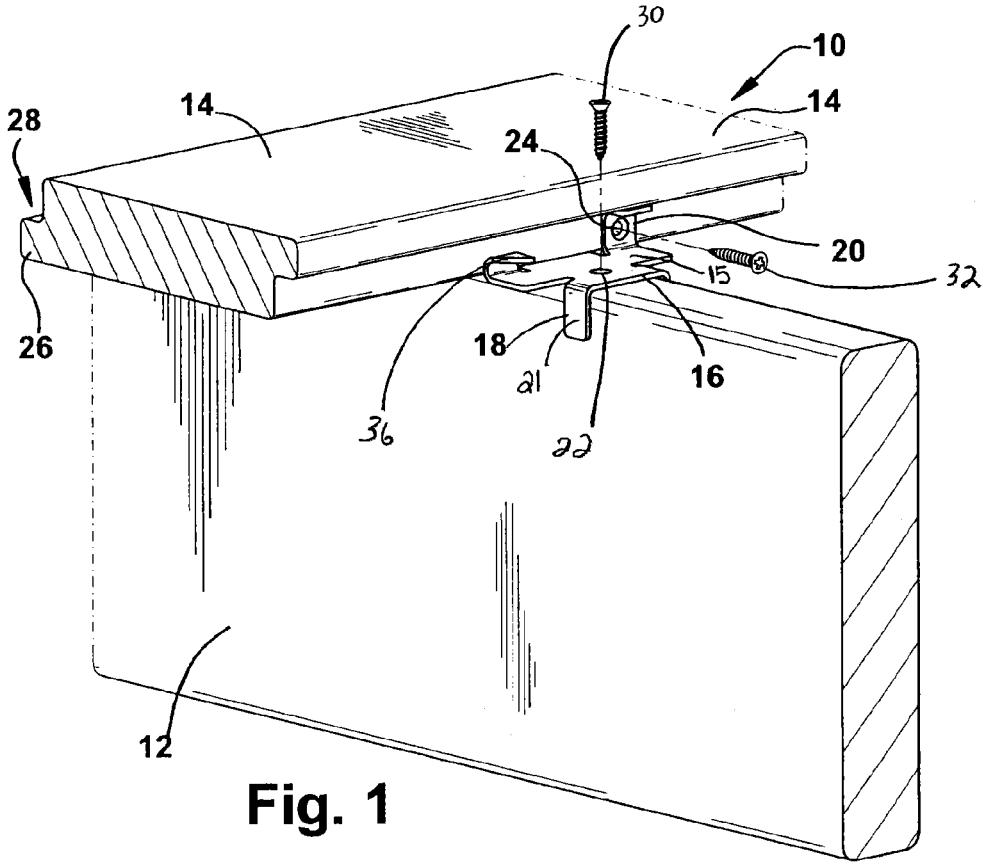
FIG. 1 is a perspective view of a decking system with embodiments of a hidden decking fastener with a single decking board installed.

With reference to FIG. 1, a decking system 10 is shown—the decking system 10 having a hidden fastener 16 as described in more detail below. The decking system 10 may be free-standing or connected to a structure on one or more sides. The decking system 10 may be generally supported by a frame (not shown.) The frame may include a plurality of posts and cross-beams configured to provide a base structure for the decking system 10.

The decking system 10 may include a series of joists 12 supported by the frame. The joists 12 may be arranged parallel to each other to provide a support grid for a plurality of decking boards 14. Alternatively, the joists 12 may be arranged in any appropriate configuration to support the decking boards 14. The decking boards 14 may be located perpendicular to the joists 12 such that each decking board 14 may be supported by multiple joists 12. Alternatively, the decking boards 14 may be arranged parallel to the joists 12 or at an angle with respect to the joists 12, such as at 45 degree angles thereto. The present teachings are not limited to a specific configuration. Any appropriate configuration of the decking system 10 may be used with the present teachings. The decking boards 14 and the joist 12 may be of any appropriate material. By way of a non-limiting example, the decking boards 14 and joist 12 may be made of wood, composite materials, plastic, rubber, aluminum or any combination of such.

The decking system 10 may include the fastener 16 to interconnect the decking boards 14 to the joists 12. The fastener 16 may be of any appropriate shape and size and is not limited to that shown and described. The fastener 16 may be made of a generally rigid material such as steel, stainless steel, aluminum, titanium, or the like. The fastener 16 may include a generally planar body portion 15 that may be capable of generally fitting between the decking board 14 and the joist 12.

The fastener 16 may include a joist connector 18 and a board connector 20, which may be integrally formed as a monolithic unit or may be attached through a subsequent operation. The joist connector 18 may be configured to engage a portion of the joist 12. By way of a non-limiting example, as illustrated in FIG. 1, the joist connector 18 may be a substantially U-shaped clamp 21 that may be sized and shaped to engage an edge of a joist 12. The clamp portion 21 of the joist connector 18 may generally hold the joist 12 via a frictional fit. Still further, the clamp portion 21 may be capable of being adjusted such that it may appropriately engage the joist 12, such as through frictional fit.

The joist connector 18 may further be nailed, screwed, bolted, snapped, or otherwise fixed to the joist 12 to prevent the fastener 16 from moving with respect to the joist 12. In some embodiments, the joist connector 18 may include an aperture 22 in an appropriate position thereof that may be shaped and to receive a connector 30, such as a nail, bolt or screw, therethrough. The connector 30 may be inserted into and through the aperture 22 and into the joist 12 engaging the joist connector 18 with the joist 12. This may further secure the fastener 16 to the joist 12. In the alternative or in addition to, the clamp portion 21 of the joist connector 18 may include a barb, tab, or the like which may engage the joist 12, which may further secure the joist connector 18 and in turn the fastener 16 with the joist 12. In such embodiments, the barb may insert into and engage the joist 12.

Figure 5:
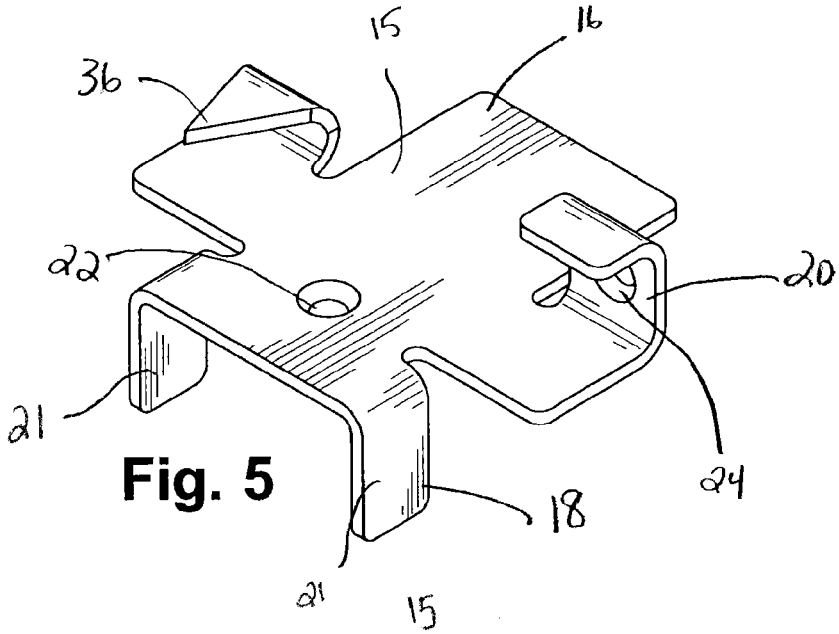
FIG. 5 is a perspective view of embodiments of the hidden decking fastener.
Figure 6:
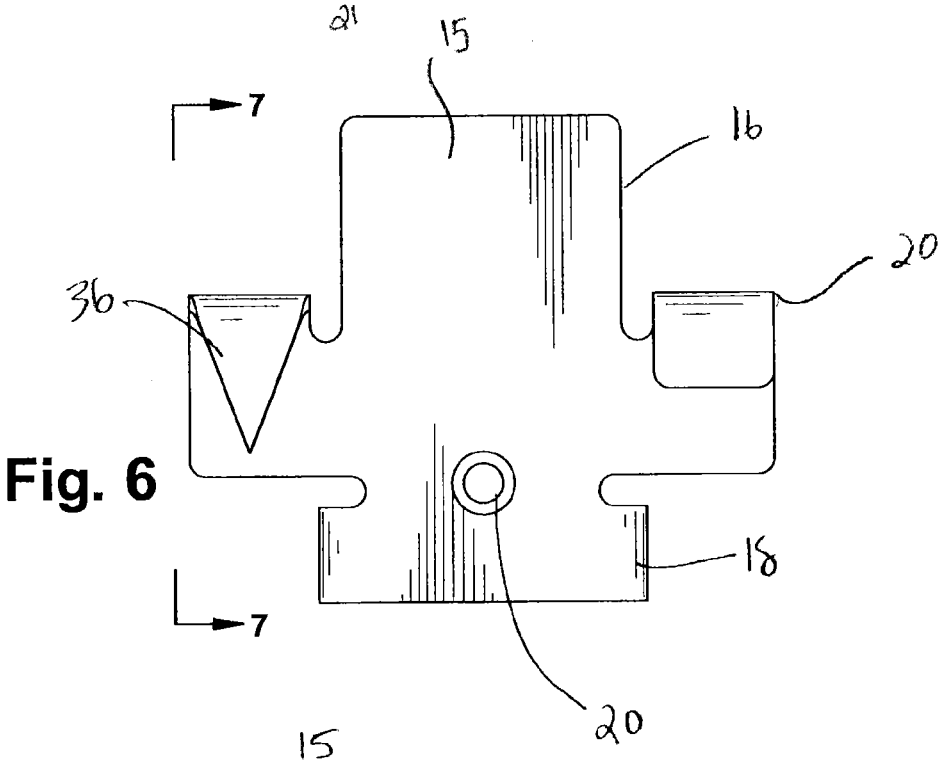
FIG. 6 is a top view of embodiments of the hidden decking fastener.
Figure 7:
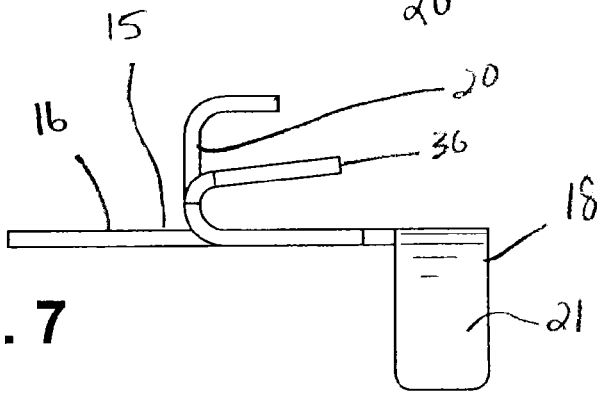
FIG. 7 is a side view of the hidden decking fastener taken along line 7-7 of FIG. 6.

The board connector 20 of the present embodiments may be a generally flat planar member configured to engage a portion of a decking board 14, such as a generally planar plate member as shown in FIGS. 5 and 7. By way of a non-limiting example, as illustrated in FIG. 1, the board connector 20 may extend from the joist connector 18 at an angle approximately perpendicular to the joist connector 18 and may be integrally formed therewith as a monolithic member. In the alternative, the board connector 20 and the joist connector 18 may be attached together through a subsequent operation.

In some embodiments, the decking board 14 may be positioned on the joist 12 and arranged such that a side portion of the decking board 14 may generally abut the board connector 20. The board connector 20 may include an aperture 24 that may be shaped and sized to receive a connector 32 such as a screw, nail, bolt or the like therethrough. The connector 32 may be inserted into and through the aperture 24 and into the decking board 14 engaging the board connector 20 with the decking board 14. This may connect the fastener 16 to the decking board 14.

Figure 2:
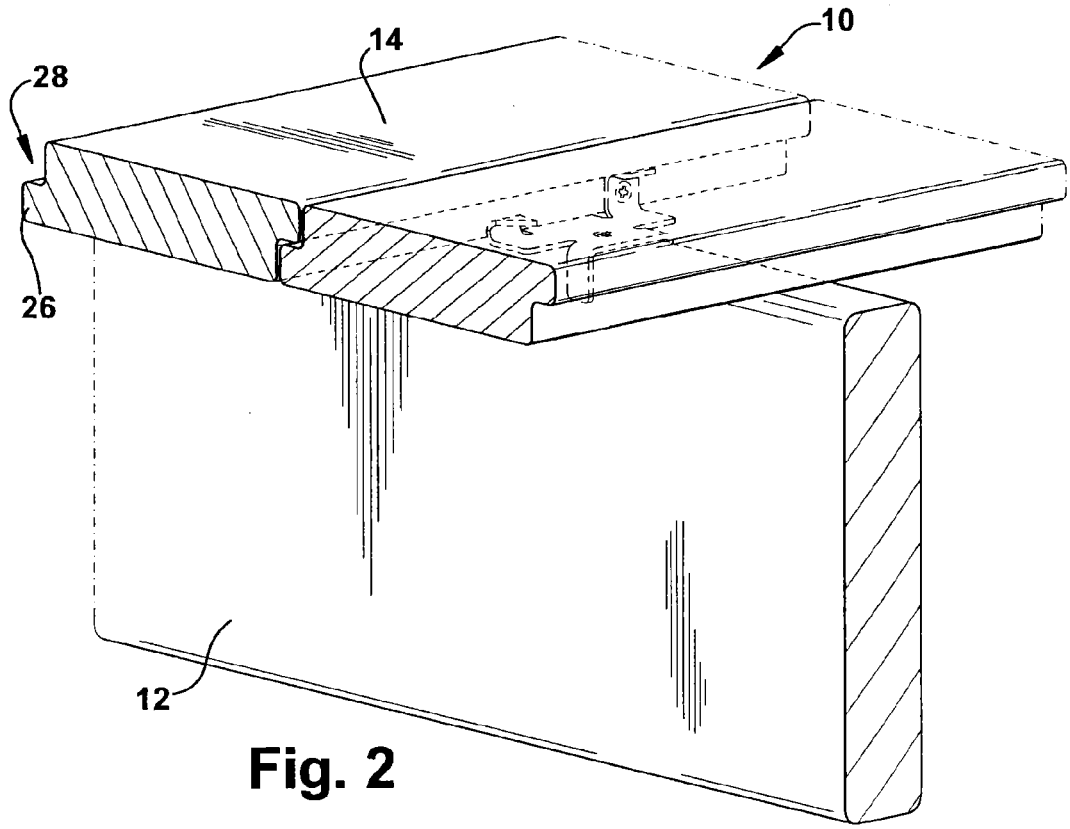
FIG. 2 is a perspective view of a decking system with embodiments of the hidden decking fastener with at least two decking boards installed.
Figure 3:
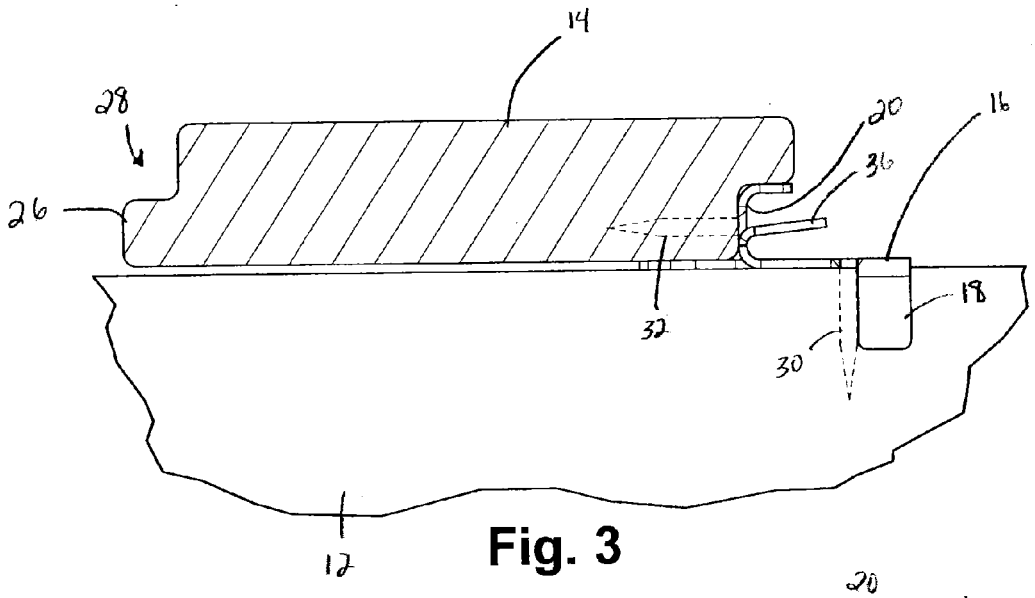
FIG. 3 is a partial cross sectional view of the decking system of FIG. 1.
Figure 4:
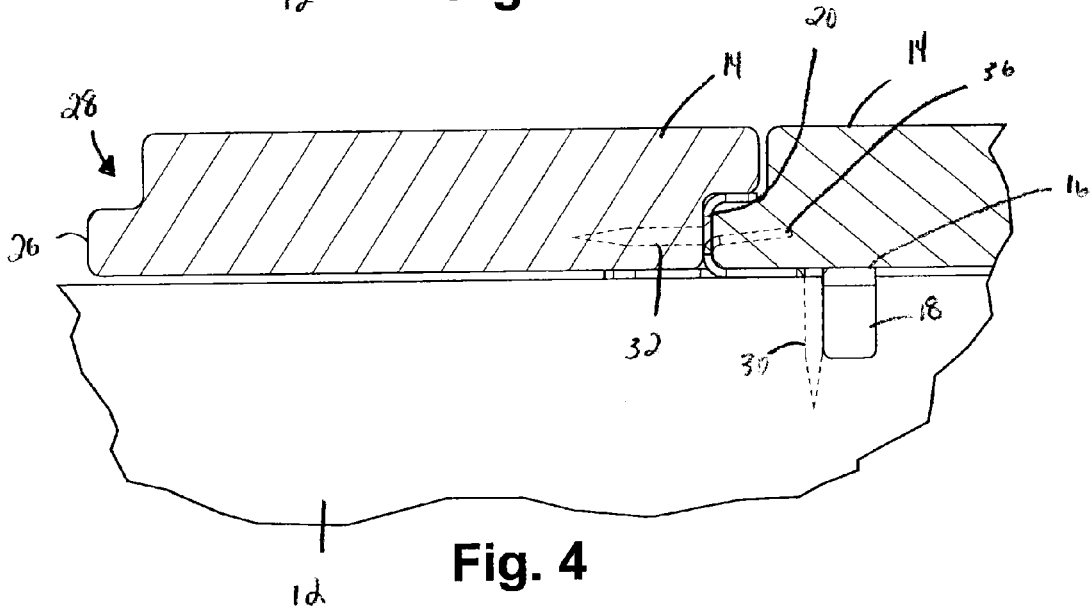
FIG. 4 is a partial cross sectional view of the decking system of FIG. 2.

In accordance with one aspect of the present teachings and as shown in FIGS. 1 and 2, the board connector 20 may be arranged to allow decking boards 14 to be aligned generally perpendicular to the joists 12. Alternatively, the board connector 20 may be angled to allow for a predetermined angled configuration of the decking boards 14 with respect to the joists 12. By way of a non-limiting example, the board connector 20 may be arranged at an angle of 45 degrees with respect to the joists 12 to allow the decking boards 14 to be mounted in a diagonal configuration. The present teachings, however, are not limited to a specific configuration. Any appropriate configuration may be used.

The decking system 10 may be configured to generally hide the fasteners 16 from a view above the decking system 10. In accordance with one aspect of the present teachings, when the fastener 16 is secured with the joist 12 and the pair of decking boards 14 depicted in FIG. 2, the fastener 16 is generally hidden from view on top of the decking boards 14. Still further, the decking system 10 may be configured to generally prevent the fasteners 16 from being exposed to environmental elements.

The decking system 10 may hide the fastener 16 by utilizing decking boards with mating portions, such as by way of a non-limiting example stepped and mating stepped recessed portions 26, 28. By way of a non-limiting example, sides of each decking board 14 may include an extended stepped portion 26 and a mating recessed stepped portion 28. The stepped/recessed portions 26, 28 may be arranged in an overlapping configuration when the decking boards 14 may be attached to the joist 12 utilizing the fastener 16. The overlapping configuration may be reversed on opposing sides of the decking board 14 to allow for engagement of adjacent decking boards 14 as shown in FIG. 2.

By way of a non-limiting example, on a first side of the decking board 14, the stepped portion 26 may be positioned above the stepped/recessed portion 28 of the other decking board 14. On the opposite side of the decking board 14, the stepped portion 26 may be positioned below the stepped/recessed portion 28. Thus, two decking boards 14 may be fit together by engaging the stepped portions 26, 28 of a first decking board 14 with the opposite portions of the other decking board 14. While this mating configuration is shown and described, the present teachings are not limited to the same. Any appropriate mating and/or overlapping configuration may be used.

In one aspect of the present teachings, the fastener 16 may be connected to the lower stepped portion 28 of the first decking board 14. Upon inspection of FIG. 1, it will be seen that the board connector 20 may connect to the side of the decking board 14 with the lower stepped portion 28 such that the stepped portion 26 overlaps the fastener 16 when the decking boards 14 are attached. As shown in FIG. 2, the stepped portion 26 of an adjacent second decking board 14 may engage the lower stepped portion 28 of the first decking board 14, which may cover the fastener 16. Thus, the fastener 16 may be hidden from view from above the decking boards 14 and may further be sheltered from rain, snow, sleet, and other environmental elements.

The fastener 16 may further include a retention feature 36 capable of engaging the second decking board 14. The retention feature 36 may connect both the first and second decking boards 14. More specifically, the fastener 20 may include a tab or barb 36, which may be capable of engaging the decking board 14. By way of a non-limiting example, the barb 36 may be of a shape and size such that it may be hammered or driven into the stepped 26 portion of the decking board 14 to further secure the fastener 16 thereto. In these embodiments, the barb 36 may further help prevent the decking boards 14 from coming loose from the joists 12, especially during windy conditions. The barb 36 may add additional security of fasteners 16 into decking boards 14. The barb 36 may engage with the decking board 16 to generally increase the securement force of the fastener 16. While the barb 26 is shown engaging the stepped portion 26, the present teachings are not limited to this. The barb 26, in other embodiments, may be capable of engaging the stepped recessed portion 28.

The decking system 10 may provide a secure fit between the decking boards 14 and the joists 12. More specifically, many of the prior art decking systems, especially those that purport to be hidden fastener systems, do not provide sufficient updraft strength. The attachment of the decking boards to the joists is not strong enough to prevent the deck boards from lifting during heavy wind conditions. The fastener 16 of the present embodiment provides a strong connection between the decking boards 14 and the joists 12. The fastener 16 may resist a predetermined amount of updraft to help prevent the deck boards 14 from lifting from the joists 12 during windy conditions. This may allow the decking system 10 and in particular the fastener 16 to be used in locations that may require building materials to withstand certain wind conditions, e.g., the decking system 10 and the fastener 16 may meet those certain wind condition requirements of Dade Country Florida.

The decking system 10 may further act as an alignment device to help ensure that the decking boards 14 appropriately align with the joists 12. More specifically, the fastener 16 may help ensure that the decking boards 14 are mounted in the proper location relative to the joists 12 and other decking boards 14. Still further, the fastener 16 may help keep the proper spacing between the joists 12 and the decking boards 14 and between each of the decking boards 14. The fastener 16 further may help keep the decking boards 14 straight—or whatever position is appropriate—relative to the other decking boards 14. In particular, the location of the board connector 20 relative to the joist connector 18 may help keep the joist 12 substantially perpendicular to the decking boards 14. In addition, when the stepped portion 26 of the decking board 14 is inserted into the fastener 16 and the tab 36 is inserted therein, this may promote proper spacing between the decking boards 14.

Still further, the fastener 16 may create space between the joist 12 and the decking boards 14. This space may allow air to be exposed to the decking boards 14 and the joists 12, which may avoid the build up of moisture. Attempting to avoid the build up of moisture may help prevent the premature deterioration of the joists 12 and/or the decking boards 14.

In operation, the decking system 10 may be installed generally in accordance with the following. While the steps are disclosed in a specific order, the present teachings are not limited to such. The steps may be combined, skipped, added and steps may be performed in a different order without departing from the present teachings. In some embodiments, the joist 12 may be attached to a frame, such as a post or the like that may be secured appropriately to the ground, other structure, or as applicable. The fastener 16 may then be appropriately positioned over the joist 12. By way of a non-limiting example, the clamp portion 21 of the joist connector 18 may engage the joist 12. The fastener 30 may then be inserted into and through the aperture 22 of the fastener 16 securing the fastener 16 with the joist 12.

The decking board 14 may then be positioned appropriately in relation to the joist 12 and the fastener 16, e.g., the decking board 14 may be positioned into engagement with the board connector 20. The fastener 32 may then be inserted into the aperture 24 of the board connector 20. This may secure the decking board 14 with the fastener 16 and the joist 12. In the alternative, the fastener 16 may be secured with the decking board 14 first and then secured with the joist 12. In these embodiments, the decking board 14 may be positioned appropriately in relation to the joist 12 and the fastener 16. The fastener 32 may then be inserted into the aperture 24 of the board connector 20. This may secure the decking board 14 with the fastener 16. Then, the clamp portion 21 of the joist connector 18 may engage the joist 12. The fastener 30 may then be inserted into and through the aperture 22 of the fastener 16 securing the fastener 16 with the joist 12 and securing the decking board 14 with the joist 12.

An additional decking board 14 may then be positioned such that the stepped portion 26 of the first decking board 14 may engage the stepped recessed portion 28 of the second decking board 14. The second decking board 14 may then be positioned such that the barb 36 may engage the second decking board 14, by way of a non-limiting example, the barb 36 may engage the stepped portion 26 of the second decking board 14. These steps may be repeated until the applicable decking boards 14 may be appropriately secured with the joists 12. This may then create an entire deck whereby such fasteners 16 may not be generally visible from the top of the deck.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

The invention claimed is:

1. A decking system comprising:

at least first and second decking boards juxtaposed each other;

a joist having side portions and a top portion generally perpendicular the side portions, wherein the first decking board includes a first stepped portion and the second decking board includes a second stepped portion whereby the first stepped portion overlays the second stepped portion;

a fastener secured with the first and second decking boards and the joist, wherein the fastener comprises:

a joist connector having a generally planar portion engaged with the top portion of the joist and a clamping member extending generally perpendicular from the planar portion and engaging the side portions of the joist, wherein the planar portion includes an aperture;

a board connector secured to the first decking board, wherein the board connector is generally perpendicular the planar portion of the joist connector and positions the first decking board in an operative position relative the joist; and a barb laterally spaced from the board connector, wherein the barb engages the second decking board.

2. The decking system of claim 1, wherein the barb engages the second stepped portion of the second decking board and the board connector is secured to the first stepped portion of the first decking board.

3. The decking system of claim 1, wherein the board connector positions the first decking board generally perpendicular the joist.

4. The decking system of claim 1, wherein the fastener secures to the first and second decking boards in a position hidden from top surfaces of the first and second decking boards.

* * * * *